United States Patent [19]

Bolker

[11] 3,943,575

[45] Mar. 16, 1976

[54] CONFORMABLE SURGICAL HOOD

[75] Inventor: James H. Bolker, Hoffman Estates, Ill.

[73] Assignee: The Kendall Company, Walpole, Mass.

[22] Filed: Apr. 12, 1974

[21] Appl. No.: 460,608

[52] U.S. Cl. ..... 2/205; 2/DIG. 7

[51] Int. Cl.[2] ..... A42B 1/04

[58] Field of Search ..... 2/205, 202, 203, 204, 206, 2/171, 68, 174, 14 W, DIG. 7; 128/142.7, 139, 141

[56] References Cited

UNITED STATES PATENTS

| | | | |
|---|---|---|---|
| 214,326 | 4/1879 | Troelicht | 2/205 |
| 427,263 | 5/1890 | Frey | 2/205 |
| 1,139,675 | 5/1915 | Harris et al. | 2/203 |
| 1,262,104 | 4/1918 | Schwerdtle | 2/203 |
| 1,800,051 | 4/1931 | Blanco | 128/141 R |
| 2,970,318 | 2/1961 | Nordling | 2/203 |
| 3,033,199 | 5/1962 | Jacobs | 128/142.7 |
| 3,084,346 | 4/1963 | Stelter | 2/202 X |
| 3,755,819 | 9/1973 | Douglas | 2/14 W |
| 3,781,916 | 1/1974 | Vitol | 2/DIG. 7 |
| 3,789,839 | 2/1974 | Lund et al. | 128/142.7 |

*Primary Examiner*—Werner H. Schroeder
*Assistant Examiner*—Peter Nerbun

[57] ABSTRACT

A disposable surgical hood which conforms to the wearer's head, and is usable either with a traditional surgical mask alone or with such a mask in combination with a laminar air flow face plate, contains bacterial fallout from the wearer's head and helps maintain sterile conditions in hospital operating rooms.

4 Claims, 4 Drawing Figures

CONFORMABLE SURGICAL HOOD

BACKGROUND

This invention relates to garments worn by operating room personnel for the maintenance of sterile conditions. In particular, it relates to hoods for the prevention or containment of bacterial fallout from the heads of the medical personnel into the operating field.

It is a continuing problem in hospital operating rooms to prevent bacterial contamination and to maintain a sterile operating field. Two specific aspects of this problem are bacterial fallout from the heads of the operating room personnel, and bacterial contamination from their exhaled breath. The problem of contamination from exhaled breath has conventionally been met by wearing a standard surgical mask. A more elaborate solution has been the use of a laminar air flow face plate to cover the entire face; a suction system is used with the face plate to remove exhaled breath from under the plate. Caps and hoods are widely used to cover the hair of the operating room personnel to contain the bacterial fallout; however, in operations demanding the highest degree of aseptic conditions, such head coverings have not been fully satisfactory when worn in combination with a face plate and vacuum system.

In general, caps cover too little of the wearer's head to be fully effective, and they do not seal against the face plate as is necessary to provide a complete barrier between the wearer and the patient. while hoods can be provided to cover the entire head, they generally have been unsatisfactory for other reasons. They are generally made of an inelastic material such as woven cloth. They must be made big enough initially to be put on over the wearer's head with the face plate in position, and as a result are bulky and include excess material when they have been put on. The excess material bunches and accumulates in folds which form open regions at the edges of hood. These open regions allow bacterial fallout, particularly around the face opening, which does not conform adequately to the face plate, and around the neck or shoulder edge of the hood.

These problems are even more severe if the same hood is worn with a traditional surgical mask alone without the face plate; the same quantity of material than covers a smaller volume and folds and bunching are increased.

It is an object of this invention to provide an inexpensive disposable surgical hood that conforms to the head and face of the wearer for effective containment of bacterial fallout.

It is a further object to provide such a hood that can be worn either with a traditional surgical mask alone, or with a laminar air flow face plate and vacuum system, and is effective to contain bacterial fallout from the wearer's head in either type of use.

SUMMARY OF THE INVENTION

This invention features a conformable disposable operating room surgical hood adapted for wear with or without a laminar air flow face plate and exhaust system. The hood comprises two flat, flexible, non-woven, fluid resistant, inelastic side sections, an air permeable, resiliently expandable inset section, and a resiliently expandable gathering means. The perimeter of each side section includes a convex crown portion, a generally straight back portion, a generally straight shoulder edge portion, a generally straight lower face portion, and a concave upper face portion. The two side sections are joined together along the crown and back perimeter portions. The inset section joins the lower face portions. The upper edge of the inset section together with the upper face portions define a closed face edge in the hood. The gathering means partially encircles the hood, drawing it inward generally around the neck of the wearer.

Other objects, features and advantages will be apparent from the following description of a preferred embodiment of the invention, taken together with the attached drawings thereof, in which.

Figure 1:
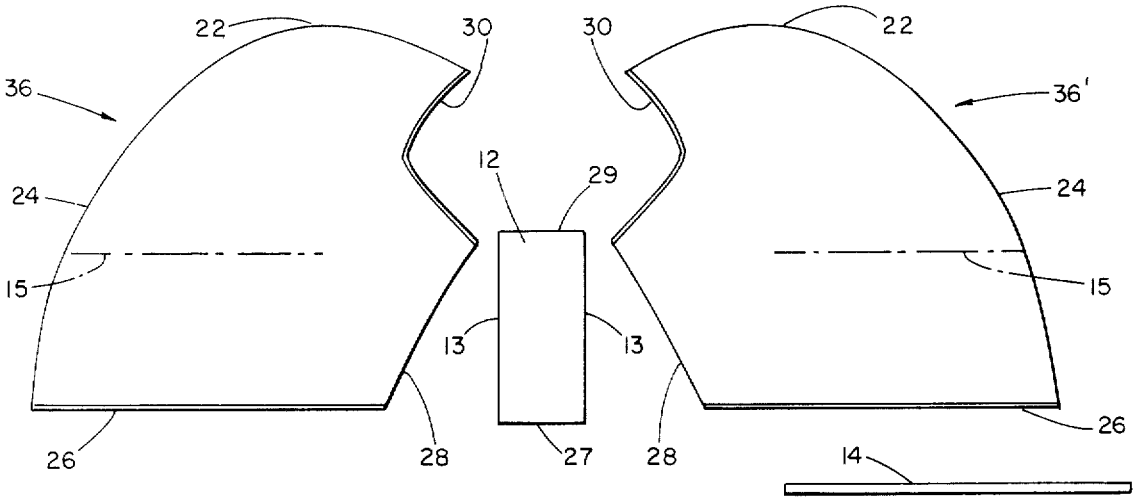
FIG. 1 shows the component portions of the hood of the invention.

Referring now to the drawings, and particularly to FIG. 1, the hood of the invention comprises two similar side sections 36 and 36', and an inset section 12. Each side section is generally flat and composed of a flexible, non-woven, fluid resistant and inelastic material, such as the spun-bonded polyolefin "Tyvek" made by Du Pont. The perimeter of each side section includes a generally convex crown portion 22, a generally straight back portion 24 adjacent the crown portion, a generally straight shoulder edge portion 26 adjacent the back portion and at about a right angle thereto, a generally straight lower face portion 28 generally parallel to the back portion adjacent the shoulder edge portion, and a generally concave upper face portion 30 between the lower face portion and the crown portion. The inset section 12 is composed of an air permeable, resiliently expandable material such as knitted orthopedic stockinette. Section 12 has side edges 13, upper edge 29 and lower edge 27.

The two side sections 36 and 36' are connected together along the convex crown portions 22 and back portions 24 of their perimeters. The lower face portions 28 of the side section perimeters are joined to the side edges 13 of inset section 12. When the sections 36, 36' and 12 of the hood have been joined as described, the shoulder edge portions 26 of sections 36 and 36' together with lower edge 27 of inset section 12 form a closed shoulder edge, and the perimeter upper face portions 30 together with upper edge 29 of inset section 12 together form a closed face edge. Upper face portions 30 are preferably reinforced by seaming or other appropriate means to maintain the length of the closed face edge constant.

After the sections 36, 36' and 12 have been joined as described, a resiliently expandable gathering means 14 of material such as elastic tape is secured to the hood along the line indicated at 15. The gathering means 14 is in stretched condition when secured to the material of the hood, so that when means 14 is allowed to return to unstretched condition, it tends to maintain the side sections in gathered configuration across the rear portion of the hood.

The areas of side sections 36 and 36' between gathering means 14 and shoulder edge portions 26, together with the area of inset section 12 adjacent its lower edge 27, together form a shoulder margin 60 extending entirely around the lower part of the hood and sufficiently long to be retained under the upper part of a surgical gown. To allow the wearer to put the hood on, the gathering means can be stretched and the hood side section material flattened out; at the same time, the resiliently expandable inset section stretches.

Hood 8 of the invention is designed to be worn either with a surgical mask alone, or in combination with a laminar air flow system including a face plate and exhaust hose.

Figure 2:
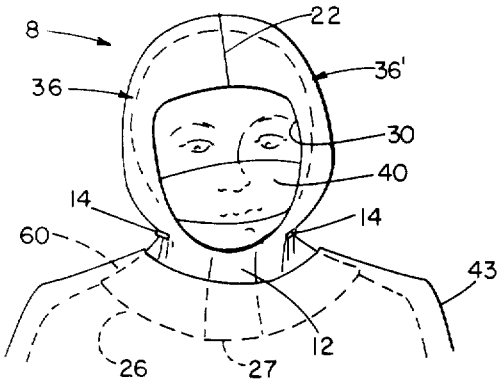
FIGS. 2 and 3 are front and side views respectively of the hood of the invention as worn with a surgical mask and gown.
Figure 3:
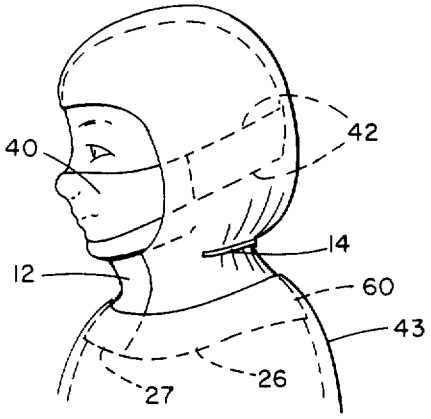

Referring now especially to FIGS. 2 and 3, the hood 8 of the invention is shown as worn in combination with a conventional surgical mask 40. Mask 40 is secured to the wearer's head by strings as at 42, and when in place, it covers the wearer's nose and mouth. Alternatively, the mask could be worn outside the hood. Gathering means 14 and inset section 12 are expanded and hood side sections 36 and 36' are flattened out to allow the hood to pass over the wearer's head, and it is brought into a position in which inset section 12 is below the wearer's chin, while all of the wearer's hair is covered by hood 8.

When the hood is worn, the resiliently expandable characteristics of inset section 12 contribute to maintaining a close fit of the closed face edge of hood 8 around the wearer's face. A surgical gown 43 is worn over the hood 8, so that shoulder margin 60 and the closed shoulder edge of hood 8 lie beneath the gown. When worn as described, bacterial fallout from the wearer's head is contained, since the hood fits closely at the face and the shoulder margin is beneath the surgical gown. The fluid resistant characteristics of side sections 36 and 36' of hood 8 enable the hood to contain perspiration and prevent contamination from that source.

Figure 4:
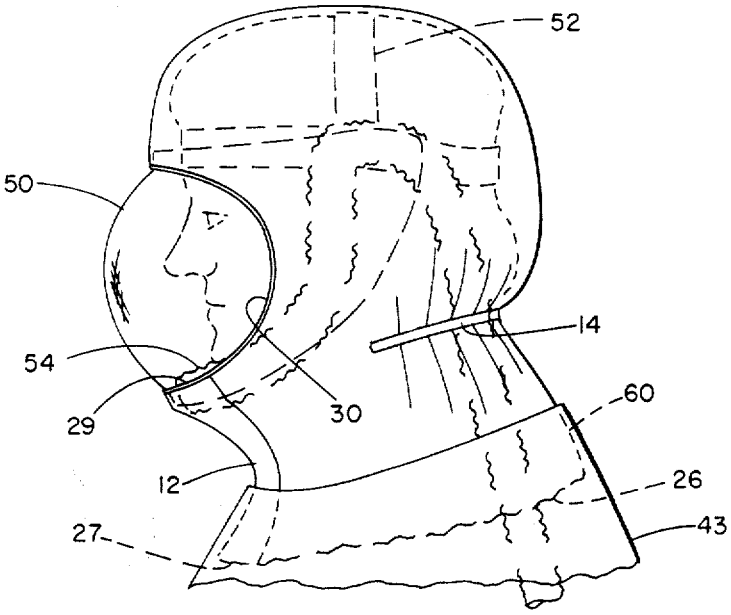
FIG. 4 is a side view of the hood as worn with a laminar air flow mask and vacuum system.

Referring now especially to FIG. 4, a laminar air flow system includes a plastic face plate 50, which is secured to a headband assembly 52. A pickup hose 54 to remove exhaled breath is secured to the headband assembly and rests on the wearer's chin beneath face plate 50. A conventional surgical mask such as that shown at 40 may be worn with this assembly if desired. The entire assembly is considerably more bulky than the surgical mask alone. Hood 8 of the invention, when worn with the laminar air flow system, is expanded as described above to be drawn over the wearer's head together with the face plate 50 and headband assembly 52. When the hood is in place, the closed face edge of hood 8 fits closely around face plate 50, while gathering means 14 maintains the back of hood 8 in gathered configuration. A surgical gown 43 is worn over the hood, so that the closed shoulder edge is beneath the gown. When worn as described, bacterial fallout from the wearer's head is contained, and the wearer is enabled to breathe confortably by inhaling through inset section 12, which is air permeable. As when worn with surgical mask 40 alone, the resiliently expandable characteristics of inset section 12 contribute to maintaining a close fit around face plate 50, while the fluid resistant characteristics of side sections 36 and 36' enable the hood to contain perspiration and prevent contamination from the source.

It will be seen that the hood of the invention is conformable and size variable to fit all wearers and provides a comfortable fit and good containment of bacterial fallout when worn with either the traditional surgical mask alone or the laminar air flow system. Hence only a single inventory of hoods need by maintained for both purposes. The hood is made of inexpensive materials and is of a simple design that is inexpensive to manufacture; hence the hoods can be disposable, eliminating the need to launder and reuse the hoods.

What is claimed is:

1. A conformable disposable operating room surgical hood adapted for wear with or without a face plate and exhaust system, said hood comprising two similar generally flat flexible non-woven, fluid resistant, inelastic side sections, the perimeter of each side section including a crown portion a back portion adjacent said crown portion a shoulder edge portion adjacent said back portion a lower face portion adjacent said perimeter shoulder edge portion, and an upper face portion between said lower face portion and said crown portion, said crown and back perimeter portions of said two side sections being joined together, generally centrally of said hood, an air permeable resiliently expandable inset portion joining said side section perimeter lower face portions, and resiliently expandable gathering means, secured to said side sections, said gathering means being secured to said side sections in stretched condition and tending to maintain said side sections across at least a portion of the rear thereof in gathered configuration, whereby said hood is conformable and size variable and is adapted to be worn over a face plate used with an exhaust system, said hood admitting air through said inset portion, or without such apparatus over a surgical mask alone, limiting bacterial contamination from the hood of the wearer, and tending to maintain sterile operating room conditions.

2. The surgical hood of claim 1 further providing a shoulder margin between said gathering means and said shoulder edge portion sufficiently long to be retained under the wearer's hospital gown.

3. The surgical hood of claim 1 in which said perimeter crown portion is generally convex, said perimeter back portion is generally straight, said perimeter shoulder edge portion is generally straight and at a right angle to said back portion, said perimeter lower face portion is generally straight, and said perimeter upper face portion is generally concave.

4. The surgical hood of claim 3 in which said resiliently expandable gathering means is secured to said side sections generally parallel to said perimeter shoulder edge portions and transverse to said joined perimeter back portions and spaced from said perimeter upper face portions and said inset portion.

* * * * *

UNITED STATES PATENT AND TRADEMARK OFFICE

CERTIFICATE OF CORRECTION

PATENT NO. : 3,943,575

DATED : March 16, 1976

INVENTOR(S) : James H. Bolker

It is certified that error appears in the above-identified patent and that said Letters Patent are hereby corrected as shown below:

Column 4, line 4, "by" should be --be--.

Signed and Sealed this

Thirteenth Day of July 1976

[SEAL]

*Attest:*

RUTH C. MASON
*Attesting Officer*

C. MARSHALL DANN
*Commissioner of Patents and Trademarks*